United States Patent [19]

Granryd

[11] 4,014,182

[45] Mar. 29, 1977

[54] METHOD OF IMPROVING REFRIGERATING CAPACITY AND COEFFICIENT OF PERFORMANCE IN A REFRIGERATING SYSTEM, AND A REFRIGERATING SYSTEM FOR CARRYING OUT SAID METHOD

[76] Inventor: Eric G. U. Granryd, Slatthalsvagen 2, S-183 64 Taby, Sweden

[22] Filed: Oct. 7, 1975

[21] Appl. No.: 620,364

[30] Foreign Application Priority Data

Oct. 11, 1974 Sweden ..... 7412825

[52] U.S. Cl. ..... 62/117; 62/196 R; 62/510

[51] Int. Cl.[2] ..... F25B 5/00; F25B 41/00; F25B 1/10

[58] Field of Search ..... 62/117, 196 R, 197, 62/509, 510, 504, 216

[56] References Cited

UNITED STATES PATENTS

| | | | |
|---|---|---|---|
| 2,277,647 | 3/1942 | Jones | 62/510 |
| 2,888,809 | 6/1959 | Rachfal | 62/510 |
| 3,074,249 | 1/1963 | Henderson | 62/510 |
| 3,226,940 | 1/1966 | Jekat et al. | 62/117 |
| 3,232,074 | 2/1966 | Weller et al. | 62/117 |
| 3,277,658 | 10/1966 | Leonard, Jr. | 62/510 |
| 3,568,466 | 3/1971 | Brandin et al. | 62/510 |
| 3,589,140 | 6/1971 | Osborne | 62/510 |

*Primary Examiner*—Lloyd L. King
*Attorney, Agent, or Firm*—Burns, Doane, Swecker & Mathis

[57] ABSTRACT

In a refrigerating system containing an evaporator, a condenser, a compressor and a closed vessel which receives condensed refrigerant from the condenser. The vessel has outlets connected to the compressor and to the evaporator. Communication between the vessel and the compressor is established for a regulated period to lower the pressure in the vessel, causing the refrigerant therein to boil. During most of this period, communication between the evaporator and the compressor is closed and thereafter is opened.

16 Claims, 7 Drawing Figures

METHOD OF IMPROVING REFRIGERATING CAPACITY AND COEFFICIENT OF PERFORMANCE IN A REFRIGERATING SYSTEM, AND A REFRIGERATING SYSTEM FOR CARRYING OUT SAID METHOD

The invention relates to a method of improving refrigerating capacity and coefficient of performance (COP) in a refrigerating system comprising an evaporation apparatus, a condensor apparatus and a compressor apparatus, the latter being adapted for sucking in and compressing refrigerant evaporated in the evaporation apparatus and transferring the compressed refrigerant to the condensor apparatus from which the condensed refrigerant is transferred to the evaporation apparatus by transferring means comprising a closed vessel connectable to the suction side of the compressor apparatus. Further intended is a refrigerating system for carrying out the new method.

All of the distinguishing features essential to the invention are apparent from the patent claims, and the invention is described with the aid of a working example, a comparison with known systems being made at the same time.

Figure 1:
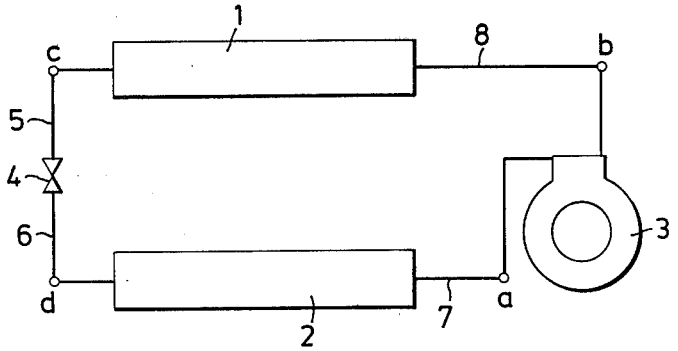
Fig. 1 PRIOR ART
Figure 2:
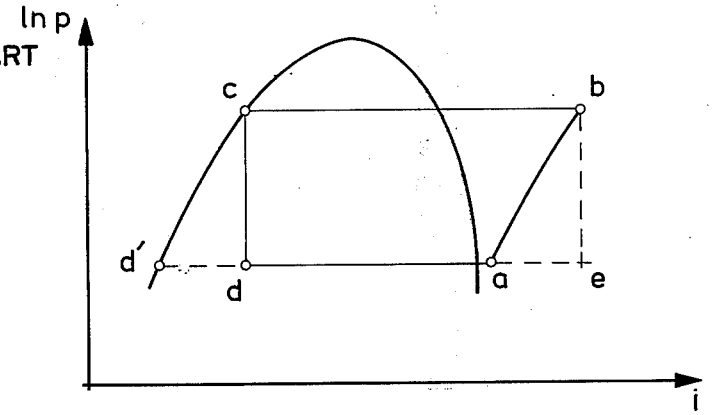
Fig. 2 PRIOR ART
Figure 3:
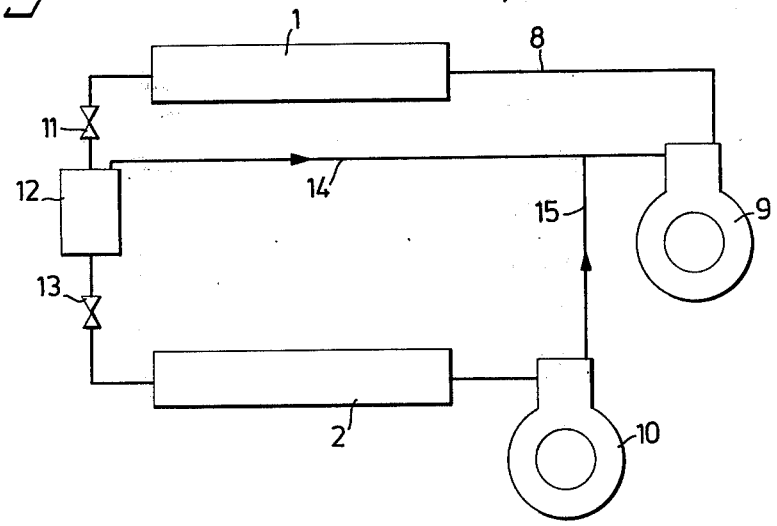
Figure 4:
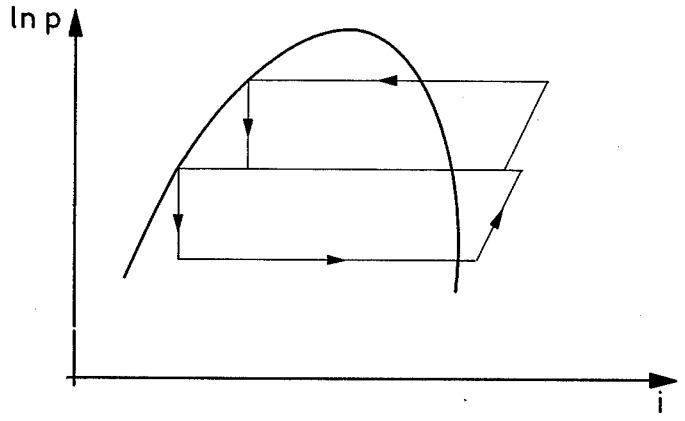
Figure 5:
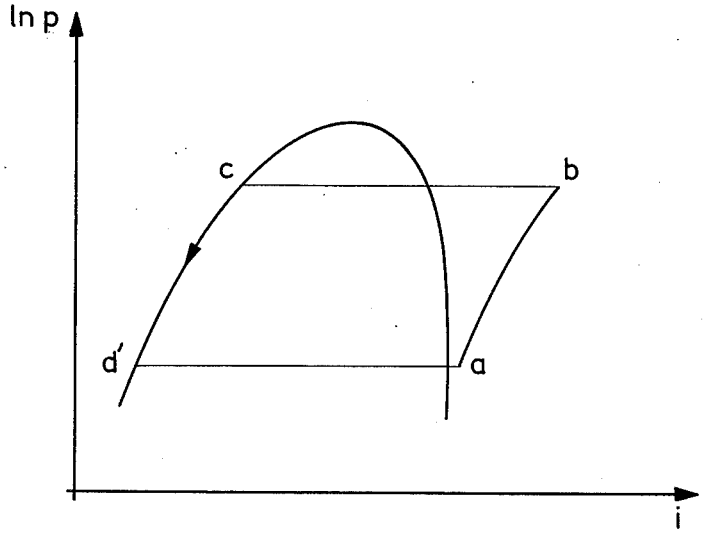
Figure 6:
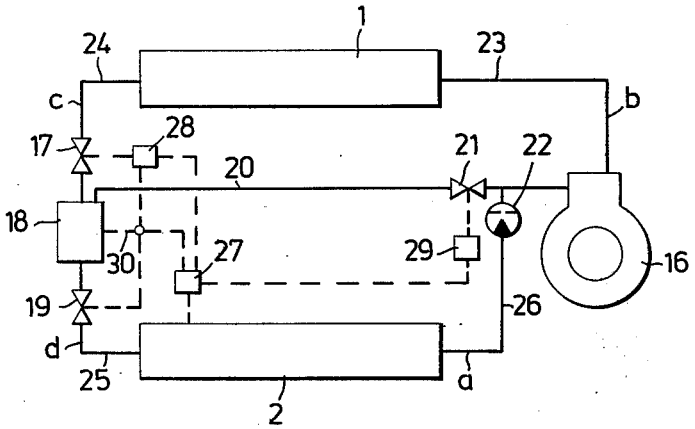
Figure 7:
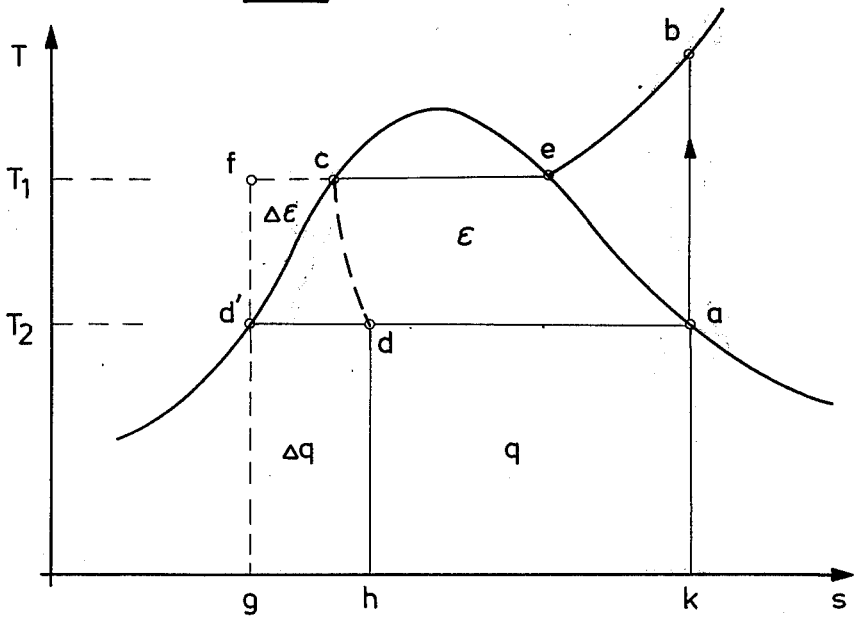

The invention will now be described in conjunction with the attached drawings, on which FIG. 1 much simplified shows a refrigerating system of conventional type, FIG. 2 shows the process in a pressure-enthalpy diagram for the system according to FIG. 1, FIG. 3 shows a known improved type of refrigerating system, FIG. 4 shows a pressure enthalpy-diagram for the process in the system according to FIG. 3, FIG. 5 shows a desired process cycle in a pressure-enthalpy diagram, FIG. 6 illustrates in a simplified manner an embodiment of the refrigerating system according to the invention and FIG. 7 shows an entropy-temperature diagram further illustrating the improvement of refrigerating capacity which can be attained according to the invention.

In FIG. 1 is shown the principle for a conventional compressor refrigerator comprising a condensor 1, which is connected to the high-pressure side of a compressor 3 over a line 8. A throttle valve 4 is connected to the outlet side of the condensor 1 via a line 5, the throttle valve in its turn being coupled by means of a line 6 to the inlet of an evaporator 2, the outlet of which is coupled to the inlet of the compressor 3 over a line 7. The system contains a refrigerant of conventional type, e.g. R12, R22, R502 or ammonia $NH_3$. The refrigerant in liquid form is drawn off from the condensor 1 and expands in the throttle valve 4 from a high-pressure $P_1$ to a low-pressure $P_2$ and obtains a boiling temperature corresponding to $P_2$, at which said liquid evaporates in the evaporator 2 while taking up heat from the surroundings. Refrigerant vapour is sucked from the evaporator 2 to the compressor 3, where it is compressed from the pressure $P_2$ to the pressure $P_1$, the latter pressure prevailing in the condensor 1 during condensation of the vapour whereat heat is dissipated to the surroundings. The process cycle in the described known system is illustrated in the pressure-enthalpy diagram of FIG. 2.

The diagram is of well-known type and the points *a*, *b*, *c* and *d* have been plotted in FIG. 1. The distance *a–e* in FIG. 2 constitutes a measure of the driving power fed into the system, i.e. substantially the power of the compressor 3, and the distance $d - a$ constitutes a measure of the refrigerating capacity. The distance $d' - d$ in the figure may be said to represent that portion of the heat of evaporation of the refrigerant which is required for reducing the temperature of the warm refrigerant liquid coming from the condensor to the temperature level prevailing in the evaporator.

An improved system can be obtained by means of different forms of two- or multi-stage throttling of the liquid, the so-called"flash-gas" formed between the throttling locations is drawn off by suction in a manner indicated in FIGS. 3 and 4.

As may be seen from FIG. 3, the outlet side of the condensor is connected via a throttle valve 11 to an intermediate pressure vessel 12 from which gas is sucked off over a line 14 by means of a high-pressure compressor 9. Via another throttle 13 refrigerant is taken from the intermediate pressure vessel 12 to the evaporator 2 which is coupled to the low-pressure side of a low-pressure compressor 10, the pressure side of which is connected to the low-pressure side of the high-pressure compressor 9. Different devices are used to reduce vapour superheating before the high-pressure compressor, although these have not been shown here. The gain which is obtained in such a system with multi-stage throttling is caused by the vapour formed after the first throttle 11 only being compressed in the high-pressure compressor. The low-pressure compressor 10 thus does not need to be burdened with the vapour formed after the first throttling. The pressure-enthalpy diagram of FIG. 4 applies to the process in the system according to FIG. 3. It is obvious that COP is improved by a two-stage division. The improvement is however obtained at the cost of extra equipment.

Theoretically, the ideal case would be that throttling with sucking off of the flash-gas takes place in such a large number of stages that the whole of the throttling cycle could be regarded as a continuous process during which refrigerant liquid is cooled from the temperature at the outlet of the condensor 1 to the evaporation temperature. A refrigerating system of such a type is however not praticable as it requires a very large number of compressor stages.

According to the invention, the last-mentioned disdadvantages with the known devices are avoided completely, and a process cycle according to FIG. 5 can be obtained, i.e. the same effect as with an infinite number of compressor stages can be entirely or substantially attained.

In the shown embodiment of the invention in FIG. 6, a first valve 17, with an outflow line freely opening out into a pre-cooling vessel 18, is coupled into the outflow line 24 of the condensor 1. To the pre-cooling vessel 18 there are connected a line 25 with a valve 19 for taking liquid refrigerant to the evaporator 2, and a suction line 20 for sucking gaseous refrigerant from the vessel 18. The line 20 is connected to the suction side of a compressor 16 via a valve 21. The pressure side of the compressor 16 is connected to the condensor 1 via a line 23. Via a line 26 and a non-return valve 22 the evaporator 2 is connected after the valve 21 on the suction side of the compressor 16. The non-return valve 22 functions so that it closes when the valve 21 is opened. For controlling the valves 17, 19 and 21 in the shown embodiment there is a sensor 27 which senses a state in the evaporator or the line 26 which is significant for the system, preferably the volume of liquid refrigerant in the evaporator 2 or the temperature in the line 26. The sensor 27 is adapted to generate control signals corresponding to this significant state for sending to the control means 28 and 29 for operating the valves 17, 19 and 21 in a manner described below.

It is assumed that a certain amount of refrigerant is in the evaporator 2 and that the compressor is working. The valves 17, 19 and 21 are closed and the system is working in a conventional manner, i.e. the compressor 16 sucks evaporated refrigerant from the evaporator 2 via the non-return valve 22 and condensing takes place in the condensor 1.

When the amount of refrigerant in the evaporator 2 is reduced to a certain minimum level, which is also often manifested by the temperature in the line 26 rising, the sensor 27 sends a signal to the control means 28 and 29, whereon the valve 17 is opened momentarily and closed thereafter. When the valve 17 opens the hot condensed refrigerant from the condensor begins to flow into the pre-cooling vessel 18, whereon the pressure in it rises. The valve 19 is still closed. Thereafter the valve 21 opens, the non-return valve 22 closes and the evaporator 2 is isolated from the compressor 16 and the condensor 1. Since the compressor 16 is connected on its suction side to the interior of the closed vessel 18 by means of a line 20 the suction end of which lies above the liquid level in the vessel 18, gaseous refrigerant in the vessel 18 will be sucked away. The liquid in the vessel 18 will thereby be caused to boil, causing cooling to be obtained. When the pressure in the vessel has sunk to a certain level, e.g. slightly above the pressure in the evaporator, this level being senses via a line 30 by the sensor 27, the valve 21 is closed and the valve 19 is opened. Cooled liquid will thereby flow to the evaporator 2, which is now coupled to the suction side of the compressor 16, and the normal refrigerating cycle is re-established, continuing until the sensor 27 once again senses a minimum amount of refrigerant in the evaporator or excessive temperature at its outlet.

After the cooled amount of refrigerant from the precooling vessel 18 has been transferred, the valve 19 is closed. The cooling period which is utilized for cooling the hot refrigerant in the pre-cooling vessel 18 embraces for example 5–20% of the total operating time. To achieve the best possible cooling function, the vessel 18 is heat-insulated and can in certain cases suitable be placed in the space which is cooled by the evaporator 2.

The process cycle described above is illustrated in a simplified form in a pressure-enthapy diagram according to FIG. 5, where, as before, *a* denotes the refrigerant state between the low-pressure side of the evaporator 2 and suction side of the compressor 16 with the valve 21 closed and the non-return valve 22 open. The point *b* denotes the condition between the compressor 16 and the evaporator 1. Point *c* denotes the state of the refrigerant which has been transferred from the condensor, or from a conventional (not shown) receiver at the condensor outlet, to the pre-cooling vessel 18 with the valve 17 open. The distance *c–d* denotes the alteration in state of the refrigerant liquid during the portion of the cycle within which the pressure in the vessel 18 is lowered and the point *d'* denotes the point in the cycle when the cooled refrigerant is transferred to the evaporator 2, in which the alteration in state *d'* – *a* takes place. In the process shown in FIG. 5 the necessary pressure differences for refrigerant flow have been neglected.

It can be simply shown that compared with the conventional process (FIG. 2) the available refrigerating capacity increases in the new process described, in spite of the compressor not being utilized together with the evaporator during the whole of the cycle. The substantial improvement of the refrigerant capacity is caused by the compressor working with a higher inlet pressure during the cooling periods, when it co-acts with the vessel 18, than during operating periods when it sucks vapour from the evaporator. This results in improvement of both the available cooling capacity in the evaporator for a given compressor size and the system COP (i.e. the relationship between refrigerating capacity and the driving power supplied for carrying out the process, which is decisive for the energy requirement) compared with what is obtained in a conventional refrigerating process. These advantages are accentuated, especially in relation to refrigerating capacity, by the fact that efficiency, especially volumetric efficiency, is improved at increased inlet pressure for the types of compressors used, provided that the outlet pressure is constant.

FIG. 7 is now referred to for further illustrating the advantages of the invention, the Figure showing a state diagram for the refrigerant, absolute temperature T being plotted along Y axis and entropy s along the X axis. A process according to the invention has been plotted on the diagram, the points *a, b, c* and *d'* corresponding to the points denoted in the same way in FIG. 5. For comparison, the conventional process cycle *a, b, c, d* has been plotted with denotations analogous to FIG. 2. The cycle for the compression *a–b* has been assumed to be isentropic in the figure.

The area defined by the points *d, a, k, h* corresponds to the refrigerating effect $q$ in a conventional system and the energy $\epsilon$ fed to the compressor in this system corresponds to the area defined by the points *a, b, e, c, d'* and *a.* In the diagram, the work $\Delta\epsilon$ theoretically required to cool down the liquid in the precooling vessel 18 in FIG. 6 from the temperature $T_1$ to $T_2$ is represented by the area which is defined by the points *c, f, d'* and *c.* The increase in the refrigerating effect which according to the invention is attained by sacrificing the work $\Delta\epsilon$ is represented by the area $\Delta q$ , defined by the points *d', d, h, g* and *d'*, It is obvious from FIG. 7 that the ratio between $\Delta q$ and $\Delta\epsilon$ is considerably greater (approximately doubled) than the ratio between $q$ and $\epsilon$ which represents the conventional refrigerating process COP. It will also be appreciated herefrom that the COP of the improved new process represented by the ratio between the surfaces $q + \Delta a$ and $\epsilon + \Delta\epsilon$ exceed the COP of the conventional process. The improvement will be all the more substantial the greater the difference is between the condensing and evaporating temperatures.

The refrigerating machine described above can naturally be used as the heat pump as well, e.g. for heating rooms. In such an application the increase in cooling effect and COP which is attained by a process according to the invention is of particular value, since the improvement increases with decreasing evaporating temperature, or generally, with increasing difference in $T_1 - T_2$.

The embodiment of the invention described above as an example can be modified in different ways. the valves 19 and 21 can thus be combined to a unit, the function of which is for example initiated by the liquid flow arising when the valve 17 opens. By means of the liquid flow arising, the valves 19 and 21 are both caused to close and when liquid flow has ceased valve 21 opens, whereafter valve 19 opens and valve 21 closes when the pressure in the vessel 18 has sunk to a level which exceeds the pressure in the evaporator by a settable value. The valve 17 can be controlled by a level sensing means in the evaporator or by a thermostatic means which senses overheating after the evaporator.

It is also possible to combine the functions of the valves 21 and 22 into a simple shunt valve which opens communication to the compressor from the line 20 and closes communication from the line 26 when the pressure in the line 20 has risen to a certain level falling below the condensor pressure, or alternatively when the temperature in the bottom of vessel 18 exceeds a certain value, the value being reset so that communication from the line 26 opens and is closed from the line 20 when the pressure in the line 20 sinks to a level exceeding the pressure in the line 26 by a certain adjustable value.

Without departing from the inventive conception it is also possible to alter the sequence of the valve functions so that the pre-cooling vessel 18 can also serve as a receiver on the high pressure side. During normal operation the valve 17 is thereby open for transferring refrigerant from the condensor 1 while the valves 19 and 21 are closed. To transfer the refrigerant liquid to the evaporator 2, valve 17 is closed and the valve 21 is opened. When pressure in the vessel 18 has sunk to a level insignificantly above the pressure in the evaporator 2, the valve 21 is closed and the valve 19 is opened, whereat liquid flows over to the evaporator or to the receiver on the low pressure side. When the vessel 18 is empty, the valve 19 is closed and valve 17 is opened, thereby terminating the transferring sequence.

It has been assumed above that in a closed position the valves 17 and 19 completely prevent flow-through of refrigerant, but it is also possible to simplify the equipment so that the valve 17 is replaced by a fixed simple throttle constantly tranferring refrigerant from the condensor 1, the valve 19 then being replaced by a fixed throttle or by a throttle valve of a kind often used in conventional cooling systems, e.g. a thermostatic expansion valve. The said fixed throttles can be made as capillary tubes. To ensure that only liquid is tranferred from the condensor to the vessel 18 it can in certain cases be suitable either to replace or to supplement the fixed throttle corresponding to the valve 17 by a so-called high pressure float valve. By giving the vessel 18 a design so that layer formation of the liquid is facilitated and maintained, heavily cooled refrigerant can be taken off at the bottom of the vessel in spite of hot refrigerant being continually transferred to the upper portion of the vessel 18. Since most refrigerants have a large coefficient of expansion for temperature and a small heat conducting value in the liquid phase, an effective layer formation is facilitated providing that flow movements within the liquid are eliminated. Cooling the liquid in the vessel 18 thereby takes place intermittently as described earlier and is initiated by the valve 21 being caused to open when the temperature of the liquid taken off from the vessel 18 has risen over a certain set level, denoting that a layer of sufficiently cooled liquid has been used or alternatively that the pressure in the vessel has increased to a certain value somewhat under the pressure in the condensor. In systems where the liquid line between the vessel 18 and the throttle valve 19 of the evaporator is long, it may be suitable also to use a non-return valve at the outlet from the vessel 18 to avoid boiling phenomena in the line at termination of the cooling periods. Thanks to the continuous supply of liquid to the upper portion of the vessel 18, the pressure in it will rise relatively rapidly as soon as the cooling period is terminated, i.e. after the valve 21 has closed, whereby the necessary operating pressure to the throttle valve of the evaporator is maintained, and bubble formation in the liquid line before it is avoided.

In certain cases it may be found advantageous to supply the vessel 18 with refrigerant during the whole of the working cycle with the exception of the period of time during which gas is sucked from the vessel. In this case refrigerant is continuously taken off from the vessel 18 to the evaporator via a throttle.

For sensing the temperature of the liquid refrigerant in the vessel 18 by means of sensing means 27, sensing suitable takes place at the vessel outlet to the evaporator, the means being such that the valve 21 is opened when the temperature at the outlet has reached a value exceeding the evaporation temperature of the refrigerant in the evaporator 2. When the temperature has sunk below the selected value the valve 21 is closed.

Other modifications of the invention are possible within the scope of the patent claims. E.g. it is thus possible to use a plurality of compressors co-acting with each other. It is also possible to use several pre-cooling vessels which are alternatingly brought into operation according to the above.

I claim:

1. A method of improving refrigerating capacity and coefficient of performance in a refrigerating system comprising an evaporation apparatus, a condensor apparatus, and a compressor apparatus the latter being adapted for sucking in via a first conduit means and compressing refrigerant evaporated in the evaporation apparatus for transferring the compressed refrigerant via a second conduit means to the condensor apparatus, from which a regulated amount of condensed refrigerant is transferred to at least one closed vessel, said amount not being sufficient to fill the vessel, the closed space above the liquid level in the vessel being connected via a third conduit means to the suction side of the compressor, there being a fourth conduit means for supplying refrigerant to the evaporation apparatus from the vessel, characterized in that communication through said third conduit means is opened for a regulated period of time to lower the pressure in the vessel and to cause the refrigerant therein to boil, that communication through said first conduit means is kept closed during the main portion of this period of time and that thereafter communication through said third conduit means is closed and communication through said first conduit means is opened.

2. A method as claimed in claim 1, characterized in that communication through said third conduit means between the vessel and the suction side of the compressor apparatus is kept open until the pressure in the vessel has sunk substantially to the pressure in the evaporation apparatus, whereafter the communication is closed.

3. A method as claimed in claim 1, characterized in that communication between said first conduit means between the evaporation apparatus and the suction side of the compressor apparatus is kept open until a certain specified least amount of refrigerant remains in the evaporation apparatus and/or a specified highest temperature is attained in said first conduit means, whereafter the communication is closed and communication through said third conduit means is opened.

4. A method as claimed in claim 1, characterized in that communication between said third conduit means between the vessel and the suction side of the compressor apparatus is opened when the pressure in the space above the liquid surface in the vessel exceeds a definite pressure value and/or when the temperature of the refrigerant exceeds a specified value and that the communication is closed when the pressure in the vessel has sunk to a value equivalent to or somewhat above the pressure in the evaporation apparatus, or falls below the temperature corresponding to said pressure in the evaporation apparatus.

5. A method as claimed in claim 4, characterized in that said definite pressure value is below the value of the pressure in the condensor apparatus.

6. A method as claimed in claim 1, characterized in that the vessel is supplied with a measured amount of refrigerant from the condensor apparatus before or in immediate conjunction with the communication through said third conduit means being opened and that the communication between said fourth conduit means is kept closed for substantially the whole of said regulated period of time.

7. A method as claimed in claim 1, characterized in that the vessel is continuously supplied with a first regulated amount of refrigerant from the condensor apparatus and that the evaporation apparatus is continuously supplied with a second regulated amount of refrigerant from the vessel.

8. A method as claimed in claim 1 characterized in that the vessel is continually supplied with a first amount of refrigerant during a portion of the working cycle lying outside said regulated time interval, and that the evaporation apparatus is continually supplied during the whole of the working cycle with a second regulated amount of refrigerant from the vessel.

9. A refrigerating system comprising an evaporation apparatus, a condensor apparatus and a compressor apparatus, the latter being adapted for sucking in via a first conduit means and compressing refrigerant evaporated in the evaporation apparatus, and transferring the compressed refrigerant via a second conduit means to the condensor apparatus, from which condensed refrigerant is transferred in regulated amounts to at least one closed vessel with the aid of transfer means, said amount not being sufficient to fill the vessel, the enclosed space above the liquid level in the container being connected to the suction side of the compressor via a third conduit means, and refrigerant being supplied to the evaporation apparatus from the vessel with the aid of a fourth conduit means, said system characterized by regulating means to keep the level of the refrigerant in the vessel within predetermined limits while retaining a space above the liquid level, a first valve means coupled into said third conduit means to open communication between the third conduit means and to connect said space with the suction side of the compressor apparatus during a first time interval in the operating cycle of the refrigerating system; second valve means coupled into the first conduit means, arranged to break communication through the first conduit means between the evaporation apparatus and the suction side of the compressor apparatus during at least the main portion of the first time interval; and sensing means adapted to sense the state in the vessel and that on an attained predetermined state to close said first valve means and open said second valve means for connecting the evaporation apparatus with the suction side of the compressor apparatus for a subsequent second time interval during which refrigerant having said predetermined state and transferred to the evaporation apparatus from the vessel with the aid of said fourth conduit means is evaporated in the evaporation apparatus.

10. A refrigerating system as claimed in claim 9, characterized in that the sensing means being arranged to detect the amount of liquid refrigerant in the evaporation apparatus and/or the temperature in said first conduit means, and when a critical value signifying that a specified least amount of refrigerant in the evaporation apparatus is detected, to cause the first valve means to come into an open position and the second valve means to a closed position.

11. A refrigerating system as claimed in claim 9, characterized in that the sensing means being arranged to sense the pressure in the vessel and the pressure in the evaporation apparatus, and that when both the pressures are substantially in mutual agreement to close said first valve means and open said second valve means.

12. A refrigerating system as claimed in claim 10, characterized in that said regulating means comprise a third valve means arranged for opening communication, in a first position, through the transfer means between the condensor apparatus and the vessel and that in a second position to close this communication, and that the sensing means being adapted for momentarily opening the third valve means on detecting said least amount of refrigerant in the evaporation apparatus, to transfer a regulated amount of refrigerant from the condensor apparatus to the vessel.

13. A refrigerating system as claimed in claim 12, characterized in that said regulating means comprise a fourth valve means adapted for closing the communication through the fourth conduit means between the vessel and the evaporation apparatus during the first time interval in the working cycle of the refrigerating system.

14. A refrigerating system as claimed in claim 9, characterized by the regulating means comprising a first throttle valve means in the transfer means for continuously transferring refrigerant from the condensor apparatus to the vessel, and by a second throttle valve means for continuously transferring refrigerant from the vessel to the evaporation apparatus.

15. A refrigerating system as claimed in claim 9, characterized in that the sensing means are arranged to sense the temperature of the liquid refrigerant at the vessel outlet and when this temperature has reached a selected value exceeding the evaporation temperature for the refrigerant in the evaporation apparatus to open the valve means, and when the temperature has sunk to a value falling below the selected value to close the valve means.

16. A refrigerating system as claimed in claim 9, characterized in that said regulating means comprise a third valve means arranged to keep the communication through the transferring means between the condensor apparatus and the vessel closed during said regulated time interval, and open during the remaining portion of the working cycle, and that a fourth valve means is arranged for continuously allowing refrigerant flow through the fourth conduit means between the vessel and the evaporation apparatus.

* * * * *